US007488392B2

(12) United States Patent
Benum et al.

(10) Patent No.: US 7,488,392 B2
(45) Date of Patent: Feb. 10, 2009

(54) SURFACE ON A STAINLESS STEEL MATRIX

(75) Inventors: Leslie Wilfred Benum, Red Deer (CA); Michael C. Oballa, Cochrane (CA); Sabino Steven Anthony Petrone, Edmonton (CA)

(73) Assignee: Nova Chemicals (International) S.A. (CH)

( * ) Notice: Subject to any disclaimer, the term of this patent is extended or adjusted under 35 U.S.C. 154(b) by 417 days.

(21) Appl. No.: 11/297,823

(22) Filed: Dec. 8, 2005

(65) Prior Publication Data

US 2006/0086431 A1 Apr. 27, 2006

Related U.S. Application Data

(62) Division of application No. 10/363,010, filed on Feb. 26, 2003, now abandoned.

(51) Int. Cl.

| | |
|---|---|
| ***C23C 8/14*** | (2006.01) |
| ***C23C 8/18*** | (2006.01) |
| ***C23C 8/34*** | (2006.01) |
| *C22C 38/18* | (2006.01) |
| *C22C 38/42* | (2006.01) |

(52) U.S. Cl. ..... 148/277; 148/284; 148/287; 420/43; 420/94; 420/97

(58) Field of Classification Search ..... 148/277, 148/284, 287; 420/43, 94, 97
See application file for complete search history.

(56) References Cited

U.S. PATENT DOCUMENTS

| | | | | |
|---|---|---|---|---|
| 6,054,231 | A | 4/2000 | Virkar et al. | 429/34 |
| 6,436,202 | B1 * | 8/2002 | Benum et al. | 148/276 |

FOREIGN PATENT DOCUMENTS

| | | |
|---|---|---|
| GB | 2159542 | 12/1985 |

* cited by examiner

*Primary Examiner*—Roy King
*Assistant Examiner*—Lois L. Zheng
(74) *Attorney, Agent, or Firm*—Kenneth H. Johnson

(57) ABSTRACT

A stainless steel comprising at least 20 weight % of chromium and at least 1.0 weight % of manganese is adapted to support an overcoating having a thickness from 1 to 10 microns of a spinel of the formula $Mn_xCr_{3-x}O_4$ wherein x is from 0.5 to 2. Preferably the overcoating is on chromia and has stability against chemical reaction at temperatures at least 25° C. higher than the uncoated chromia.

5 Claims, 7 Drawing Sheets

SURFACE ON A STAINLESS STEEL MATRIX

This is a division of application Ser. No. 10/363,010 filed on Feb. 26, 2003 now abandoned.

TECHNICAL FIELD

The present invention relates to stainless steel having a high chrome content adapted to support a spinel, preferably overcoating chromia. The overcoated surface has superior chemical stability in coke-forming environments of at least 25° C. higher than a surface without the spinel (e.g. the chromia). Such stainless steel may be used in a number of applications, particularly in the processing of hydrocarbons and in particular in pyrolysis processes such as the dehydrogenation of alkanes to olefins (e.g. ethane to ethylene or propane to propylene); reactor tubes for cracking hydrocarbons; or reactor tubes for steam cracking or reforming.

BACKGROUND ART

It has been known for some time that the surface composition of a metal may have a significant impact on its utility. It has been known to treat steel to produce an iron oxide layer that is easily removed. It has also been known to treat steel to enhance its wear resistance. As far as Applicants are aware there is not a significant amount of art on selecting a steel composition to support an overcoat (preferably on chromia) to significantly reduce coking in hydrocarbon processing.

It is known that some steels (e.g. high chromium steels) will produce a chromia coating under certain conditions. It is predicted that chromia stability against coking is significantly reduced under conditions where the carbon activity is about 1 (e.g. with a deposit of a carbon or coke layer). For example at temperatures greater than about 950° C. and at low oxygen partial pressures chromia starts to be converted to chromium carbides. Such carbide formation leading to volume expansion, embrittlement and possible spallation, thereby leaving the surface unprotected and reducing the coking resistance of the steel tubes. The present invention seeks to address this problem.

U.S. Pat. No. 3,864,093 issued Feb. 4, 1975 to Wolfla (assigned to Union Carbide Corporation) teaches applying a coating of various metal oxides to a steel substrate. The oxides are incorporated into a matrix comprising at least 40 weight % of a metal selected from the group consisting of iron, cobalt, and nickel and from 10 to 40 weight % of aluminum, silicon and chromium. The balance of the matrix is one or more conventional metals used to impart mechanical strength and/or corrosion resistance. The oxides may be oxides or spinels. The patent teaches that the oxides should not be present in the matrix in a volume fraction greater than about 50%, otherwise the surface has insufficient ductility, impact resistance, and resistance to thermal fatigue. The reference does not teach overcoatings to protect chromia nor does it suggest the composition of a steel adapted to support such a coating.

U.S. Pat. No. 5,536,338 issued Jul. 16, 1996 to Metivier et al. (assigned to Ascometal S.A.) teaches annealing carbon steels rich in chromium and manganese in an oxygen rich environment. The treatment results in a surface scale layer of iron oxides slightly enriched in chromium. This layer can easily be removed by pickling. Interestingly, there is a third sub-scale layer produced which is composed of spinels of Fe, Cr and Mn. This is opposite to the subject matter of the present patent application. U.S. Pat. No. 4,078,949 issued Mar. 14, 1978 to Boggs et al. (assigned to U.S. Steel) is similar to U.S. Pat. No. 5,536,338 in that the final surface sought to be produced is an iron based spinel. This surface is easily subject to pickling and removing of slivers, scabs and other surface defects. Again this art teaches away from the subject matter of the present invention.

U.S. Pat. No. 5,630,887 issued May 20, 1997 to Benum et al. (assigned to Novacor Chemicals Ltd. (now NOVA Chemicals Corporation)) teaches the treatment of stainless steel to produce a surface coating having a thickness from about 20 to 45 microns, comprising from 15 to 25 weight % of manganese and from about 60 to 75 weight % of chromium.

The reference is silent about the composition of the outer layer and the presence of a chromia layer.

DISCLOSURE OF INVENTION

The present invention provides a stainless steel adapted to support a spinel surface having a thickness from 1 to 10 microns comprising not less than 80 weight % of a spinel of the formula $Mn_xCr_{3-x}O_4$ wherein x is from 0.5 to 2, said stainless steel comprising at least 20 weight % of chromium, at least 1.0 weight % of manganese, less than 1.0 weight % of niobium, and less than 1.5 weight % of silicon.

The present invention also provides an overcoating on chromia of the formula $Cr_2O_3$ which overcoating provides stability against carburizing or oxidation at temperatures at least a 25° C. higher than said chromia.

The present invention further provides a layered surface having a thickness of from 2 to 30 microns on a stainless steel substrate, said surface comprising an outermost layer and at least one layer intermediate the outermost layer and the substrate, said at least one layer intermediate the outermost layer and the substrate comprising not less than 80 weight % of chromia of the formula $Cr_2O_3$ and said outermost layer having a thickness from 1 to 10 microns comprising not less than 80 weight % of a spinel of the formula $Mn_xCr_{3-x}O_4$ wherein x is from 0.5 to 2 and covering not less than 100% of the geometrical area defined by said at least one layer intermediate the outermost layer and the substrate.

In accordance with a further aspect of the present invention there is provided a process for treating a stainless steel comprising at least 20 weight % of chromium, at least 1.0 weight % of manganese, less than 1.0 weight % of niobium, and less 1.5 weight % of silicon which process comprises:

(i) heating the stainless steel in a reducing atmosphere comprising from 50 to 100 weight % of hydrogen; from 0 to 50 of one or more inert gases at rate of 100° C. to 150° C. per hour to a temperature from 800° C. to 1100° C.;

(ii) then subjecting the stainless steel to an oxidizing environment having an oxidizing potential equivalent to a mixture of from 30 to 50 weight % of air and from 70 to 50 weight % of one or more inert gases at a temperature from 800° C. to 1100° C. for a period of time from 5 to 40 hours; and (iii) cooling the resulting stainless steel to room temperature at a rate so as not to damage the surface on the stainless steel.

BEST MODE FOR CARRYING OUT THE INVENTION

Figure 1:
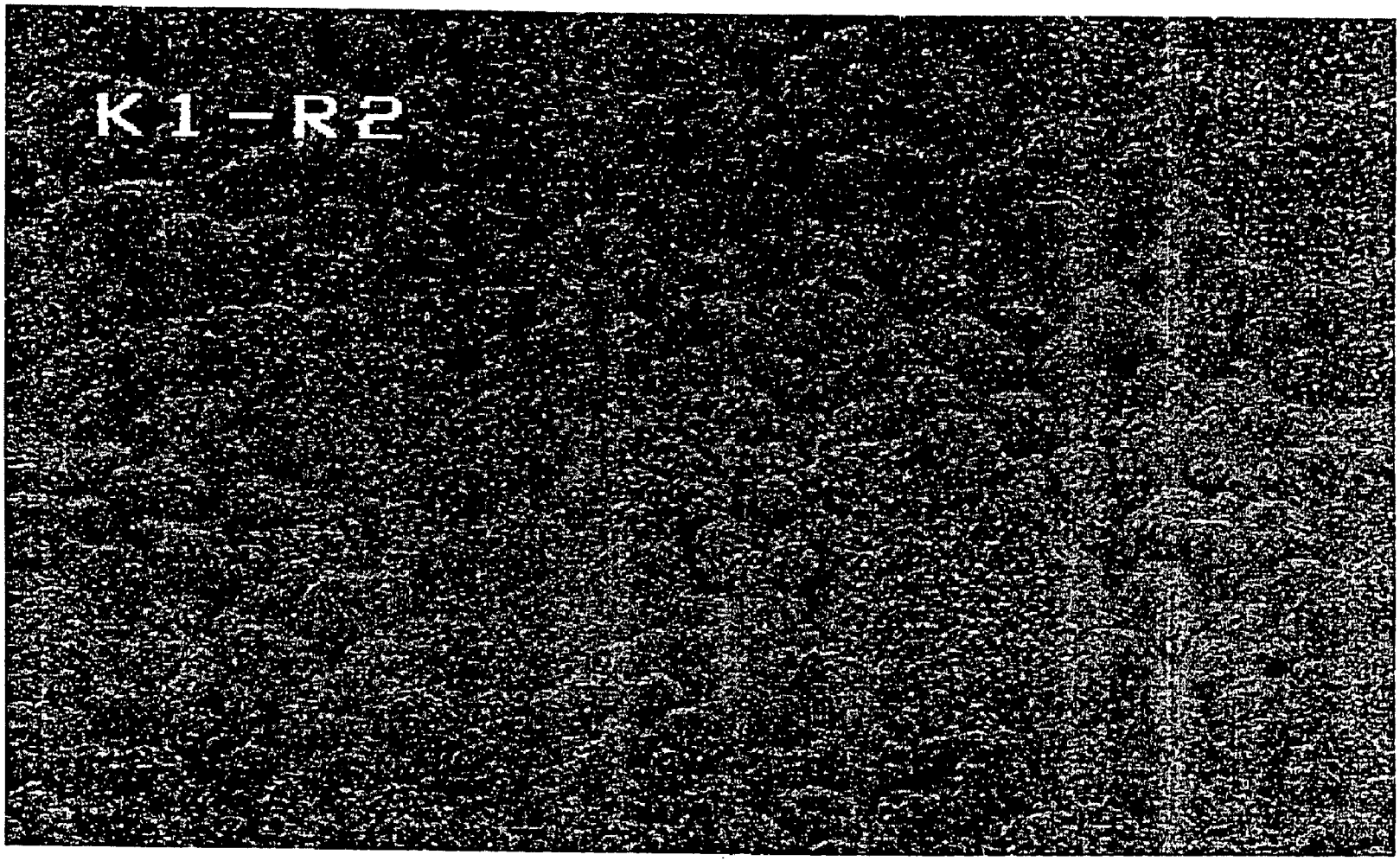
FIG. 1 is an SEM micrograph of the spinel overcoating of the present invention (low magnification 7,500×) exemplifying the high surface coverage (e.g. not less than 95%).

The stainless steel which is the subject matter of the present invention typically comprises from 20 to 50, preferably from 20 to 38 weight % of chromium and at least 1.0 weight %, up to 2.5 weight % preferably not more than 2 weight % of manganese. The stainless steel should contain less than 1.0, preferably less than 0.9 weight % of niobium and less than 1.5, preferably less than 1.4 weight % of silicon. The stainless steel may further comprise from 25 to 50 weight % of nickel, from 1.0 to 2.5 weight % of manganese and less than 3 weight % of titanium and all other trace metals, and carbon in an amount of less than 0.75 weight. The steel may comprise from about 25 to 50, preferably from about 30 to 45 weight % nickel and generally less than 1.4 weight % of silicon. The balance of the stainless steel is substantially iron.

The stainless steel part has a layered surface having a thickness of from 2 to 30 microns on a stainless steel substrate, said surface comprising an outermost layer and at least one layer intermediate the outermost layer and the substrate, said at least one layer intermediate the outermost layer and the substrate comprising not less than 80 weight % of chromia preferably of the formula $Cr_2O_3$ and said outermost layer (or overcoating layer) having a thickness from 1 to 10 microns comprising not less than 80 weight % of a spinel of the formula $Mn_xCr_{3-x}O_4$ wherein x is from 0.5 to 2 and covering essentially 100% of the geometrical area defined by said at least one layer intermediate the outermost layer and the substrate.

Intermediate the outer most layer or overcoating layer and the stainless steel substrate is at least one layer intermediate the outermost layer and the substrate comprising not less than 80, preferably greater than 95, most preferably greater than 99 weight % of chromia preferably of the formula $Cr_2O_3$. The chromia layer covers not less than 80, preferably not less than 95, most preferably not less than 99% of the geometric surface of a stainless steel which is exposed to a hydrocarbon feed stream (e.g. a hydrocarbon feed stream flowing over the outer surface of the stainless steel. Preferably the chromia layer is immediately (below) the outer spinel layer. The outermost spinel layer consists of crystallites that cover the chromia layer. That is, essentially 100% of the geometrical area of the chromia is overcoated with the spinel. The spinel crystallite structure effectively increases surface area relative to the geometrical area defined by the base steel alloy and the plate-like chromia layer. This increase in surface area afforded by the spinel crystallites is at least 50% and preferably 100% and most preferably 200% or greater of the surface area defined by the chromia (i.e. the surface of the spinel crystallites is greater than the surface area of the chromia plates). This enhancement of surface area is expected, among other things, to significantly increase heat transfer capability where it is a desirable property.

The spinel outer surface or over coating has a thickness from 1 to 10, preferably from 2 to 5 microns and is selected from the group consisting of a spinel of the formula $Mn_xCr_{3-x}O_4$ wherein x is from 0.5 to 2; preferably x is from 0.8 to 1.2, most preferably x is 1 and the spinel has the formula $MnCr_2O_4$.

The overall surface layers have a thickness from 2 to 30 microns. The surface layers at least comprise the outer surface preferably having a thickness from 1 to 10, preferably from 2 to 5 microns. The chromia layer generally has a thickness up to 25 microns generally from 5 to 20, preferably from 7 to 15 microns. As noted above the spinel overcoats the chromia geometrical surface area. There may be very small portions of the surface which may only be chromia and do not have the spinel overlayer. In this sense the layered surface may be non-uniform. Preferably, the chromia layer underlies or is adjacent not less than 80, preferably not less than 95, most preferably not less than 99% of the spinel.

The spinel overlayer over the chromia provides stability against oxidation or carburization at temperature at least 25° C. higher than that of the underlying chromia. In environments having a carbon activity of approximately 1, for example (without limiting the scope of this disclosure) in a steam cracker at a temperature from 900° C. to 1050° C. using a hydrocarbon feed stream (e.g. low reducing atmosphere) the spinel overcoating has a stability against carburization typically from 25° C. to 50° C. higher than that for the corresponding chromia. In an oxidizing atmosphere the spinel overcoat provides a stability against oxidation at temperatures from 25° C. to 100° C. higher than the corresponding chromia.

One method of producing the surface of the present invention is by treating the shaped stainless steel (i.e. part which may have been cold worked prior to treatment) in a process which might be characterized as a heat/soak/cool process. The process comprises:

(i) heating the stainless steel in a reducing atmosphere comprising from 50 to 100, preferably 60 to 100, weight % of hydrogen and from 0 to 50, preferably from 0 to 40 weight % of one or more inert gases at rate of 100° C. to 150° C., preferably from 120° C. to 150° C., per hour to a temperature from 800° C. to 1100° C.;

(ii) then subjecting the stainless steel to an oxidizing environment having an oxidizing potential equivalent to a mixture of from 30 to 50 weight % of air and from 70 to 50 weight % of one or more inert gases at a temperature from 800° C. to 1100° C. for a period of time from 5 to 40, preferably from 10 to 25, most preferably from 15 to 20 hours; and (iii) cooling the resulting stainless steel to room temperature at a rate so as not to damage the surface on the stainless steel.

Inert gases are known to those skilled in the art and include helium, neon, argon and nitrogen, preferably nitrogen or argon.

Preferably the oxidizing environment in step (ii) of the process comprises 40 to 50 weight % of air and the balance one or more inert gases, preferably nitrogen, argon or mixtures thereof.

In step (iii) of the process the cooling rate for the treated stainless steel should be such to prevent spalling of the treated surface. Typically the treated stainless steel may be cooled at a rate of less than 200° C. per hour.

Other methods for providing the surface of the present invention will be apparent to those skilled in the art. For example the stainless steel could be treated with an appropriate coating process for example as disclosed in U.S. Pat. No. 3,864,093.

Without wishing to be bound by theory it is believed that there may be other layers beneath the chromia such as silica or manganese oxides. It is believed that during the treatment of the steel the chromium from the surface of the steel initially forms a chromia layer, subsequently, the chromium and maganese from the steel may migrate through the chromia layer and form the spinel as the overcoating.

The stainless steel is formed into a part and the surface may be cold worked during or after formation of the part (e.g. boring, honing, shot peening or extrusion), and then the appropriate surface is treated. The steel may be forged, rolled or cast. In one embodiment of the invention the steel is in the form of pipes or tubes. The tubes have an internal surface in accordance with the present invention. These tubes may be used in petrochemical processes such as cracking of hydrocarbons and in particular the cracking of ethane, propane, butane naphtha, gas oil or mixtures thereof. The stainless steel may be in the form of a reactor or vessel having an interior surface in accordance with the present invention. The stainless steel may be in the form of a heat exchanger in which either or both of the internal and/or external surfaces are in accordance with the present invention. Such heat exchangers may be used to control the enthalpy of a fluid passing in or over the heat exchanger.

A particularly useful application for the surfaces of the present invention is in furnace tubes or pipes used for the cracking of alkanes (e.g. ethane, propane, butane, naphtha or mixtures thereof) to olefins (e.g. ethylene, propylene, butene, etc.). Generally in such an operation a feedstock (e.g. ethane) is fed in a gaseous form to a tube, typically having an outside diameter ranging from 1.5 to 8 inches (e.g. typical outside diameters are 2 inches about 5 cm; 3 inches about 7.6 cm; 3.5 inches about 8.9 cm; 6 inches about 15.2 cm and 7 inches about 20 cm). The tube or pipe runs through a furnace generally maintained at a temperature from about 900° C. to 1050° C. and the outlet gas generally has a temperature from about 800° C. to 900° C. As the feedstock passes through the furnace it releases hydrogen (and other byproducts) and becomes unsaturated (e.g. ethylene). The typical operating conditions such as temperature, pressure and flow rates for such processes are well known to those skilled in the art.

The present invention will now be illustrated by the following non-limiting examples. In the examples unless otherwise stated parts is parts by weight (e.g. grams) and percent is weight percent.

EXAMPLES

Example 1

Sample Preparation: Sample preparation is from a commercially specified furnace tubes having a composition of the present invention with a bulk chromium content of about 33% (by weight) and manganese of about 1% (by weight). The sample was then heated in an oven up to 1000° C. in a reducing atmosphere and maintained at 1000° C. for about 16 hours in an atmosphere of a mixture of nitrogen and air, then cooled back down to room temperature.

Metallographic analysis of specimens was carried out by conventional techniques used for characterizing damage-sensitive oxide scales on steels as known to those versed in the art.

Surface structural and chemical analysis was carried out using Scanning Electron Microscopy equipped with light-element Energy Dispersive Spectroscopy (SEM/EDS, Hitachi S-2500), a high resolution field-emission SEM also with light element capability (FESEM-EDS, Hitachi S-4500), Scanning Auger Microprobe (SAM, PHI 600) and Time-of-Flight Secondary Ion Mass Spectrometry (Cameca TOF-SIMS IV).

Figure 2:
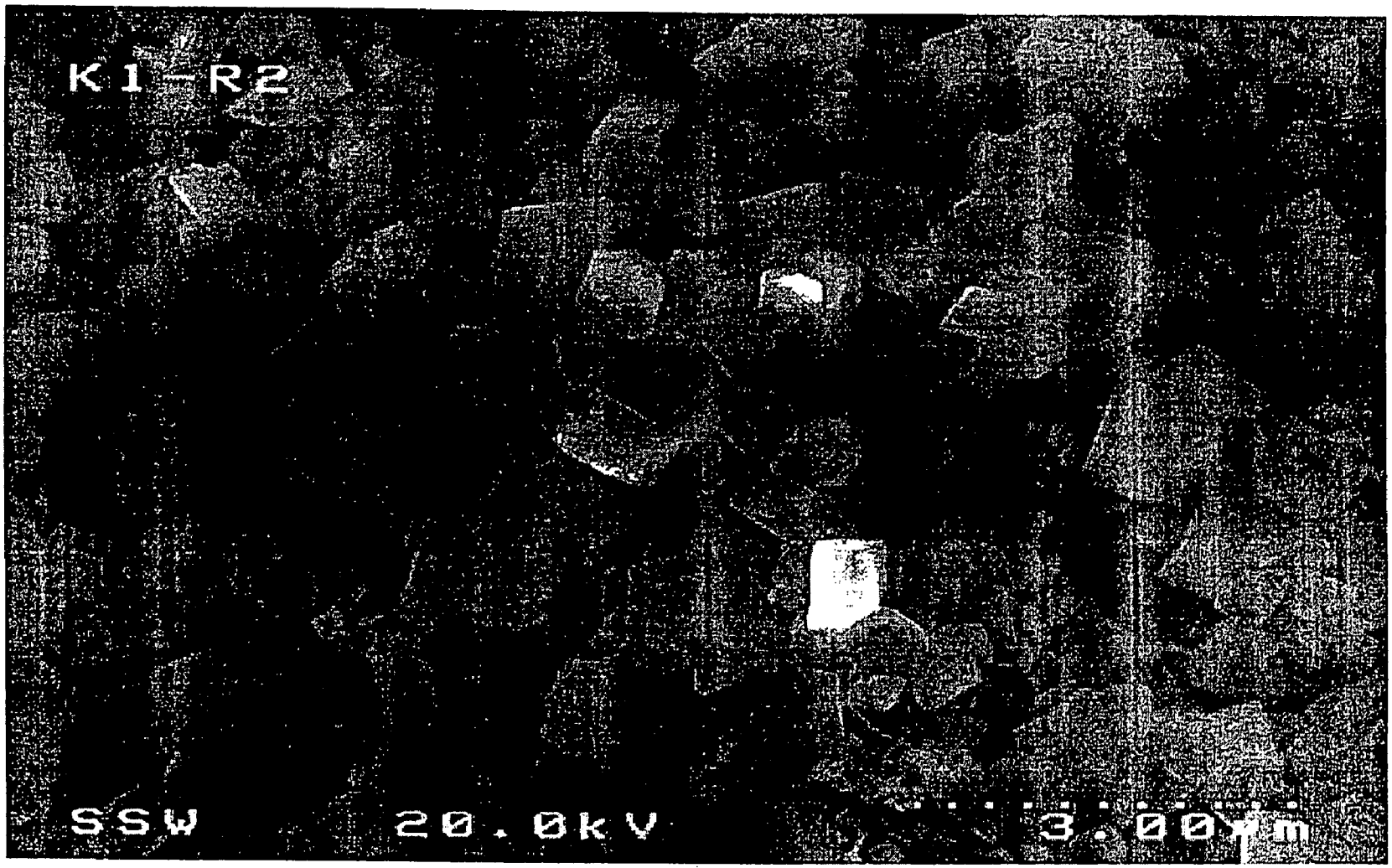
FIG. 2 is an SEM micrograph of the same spinel overlayer of the present invention (high magnification 25,000×) exemplifying high surface area (e.g., not less than 150% of the surface of the substrate).
Figure 3:
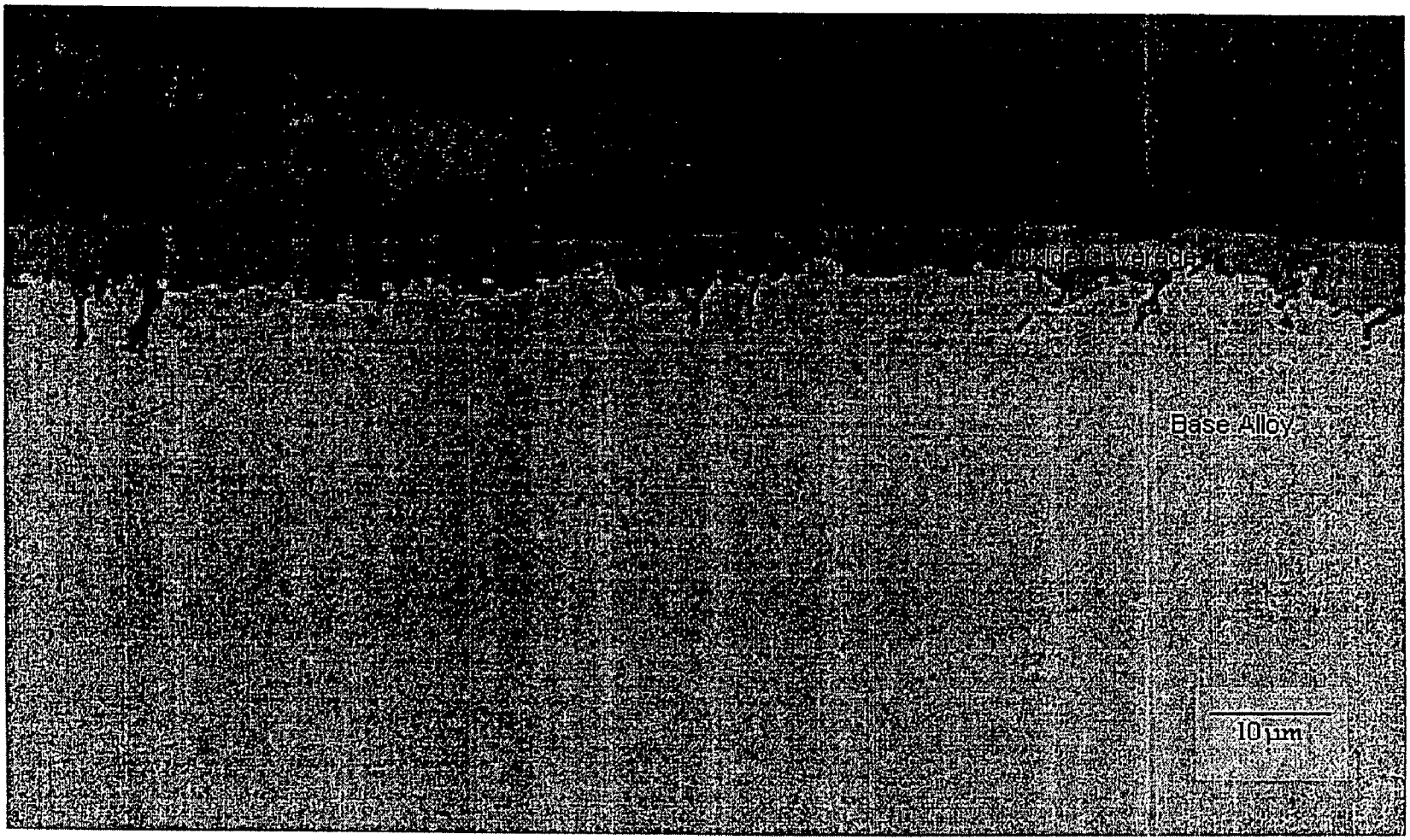
FIG. 3 is a metallographic cross-section (magnification 1,000×) of the present invention exemplifying the oxide coverage consisting of a chromia sub-scale with a spinel overcoating. The micrograph also shows the presence of discontinuous silica phase at the steel-oxide interface.

FIGS. 1 and 2 are FESEM micrographs of these samples and FIG. 3 is a typical metallographic cross-section.

Example 2

Sample Preparation: Coupons from the inlet and outlet of the commercially treated tube were used. Additionally, the same alloy was treated in a comparable manner using laboratory equipment.

Figure 4:
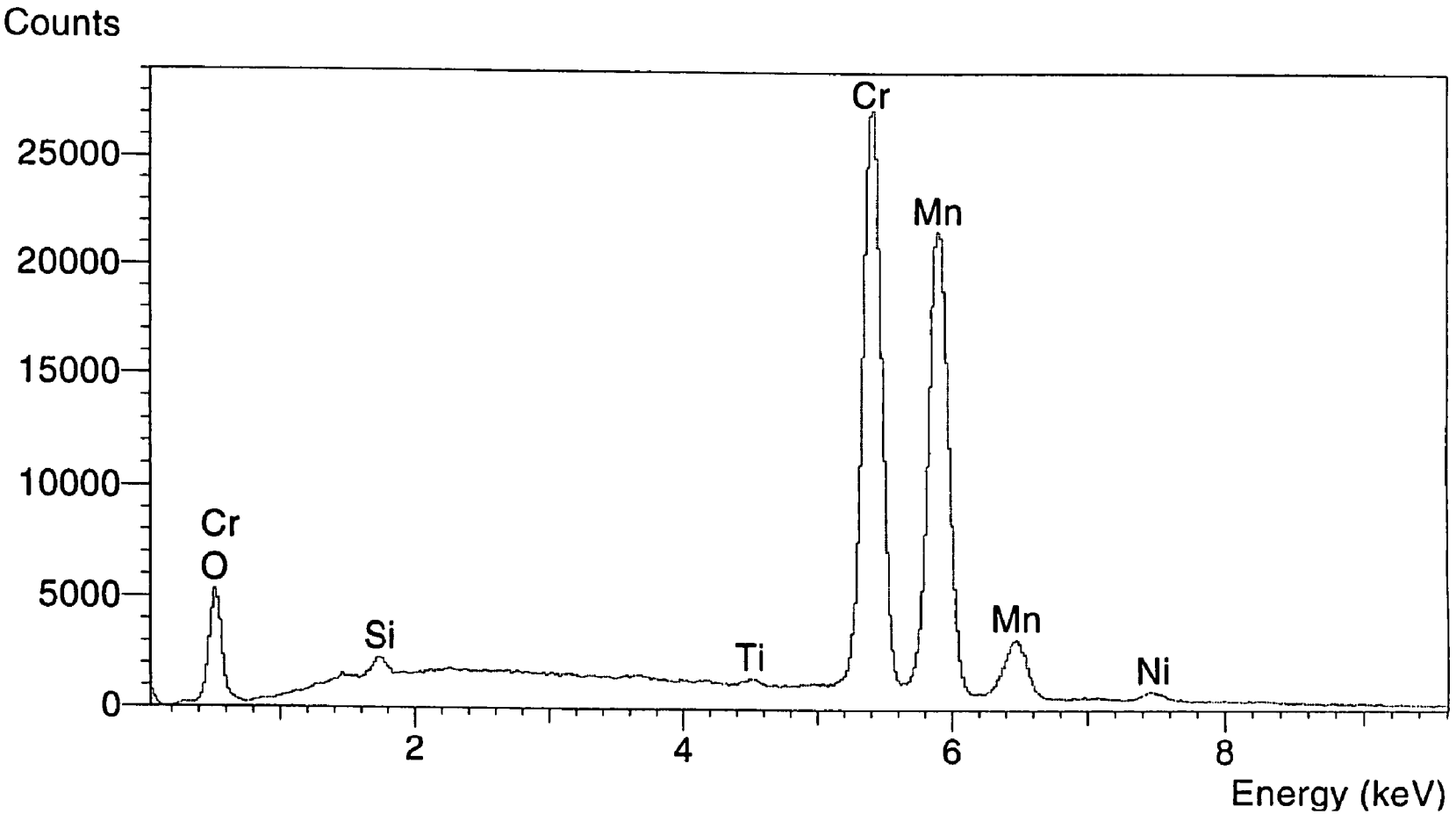
FIG. 4 is a typical EDS spectrum of the present invention.

FIG. 4 shows an EDS spectrum of the laboratory pretreated coupon. Table 1 shows the elemental concentration on the surface of treated alloy coupon or coils. The results in column two are from coupons that were cut out of a commercial tube and treated in the laboratory. Columns three and four show the results of the pretreated commercial coil of Example 1. The results show very good agreement in the capability of the process to increase the content of Mn and Cr on the surface tremendously and decrease nickel content significantly. Also, the content of iron was reduced to a level which was not detectable by the analytical tool that was used.

TABLE 1

EDS Results of Treated Alloy

| Element | Laboratory Treatment Results | Commercial Plant Treatment Results (Coil Inlet) | Commercial Plant Treatment Results (Coil Outlet) |
|---|---|---|---|
| O | 4.0 | 6.0 | 6.3 |
| Al | 0.0 | 0.0 | 0.0 |
| Si | 0.4 | 1.7 | 2.7 |
| Ca | 0.0 | 0.3 | 0.5 |
| Cr | 48.0 | 47.2 | 44.6 |
| Mn | 45.7 | 42.5 | 44.2 |
| Fe | 0.0 | 0.0 | 0.0 |
| Ni | 1.9 | 2.3 | 1.8 |
| Nb | 0.0 | 0.0 | 0.0 |

Example 3

Figure 5:
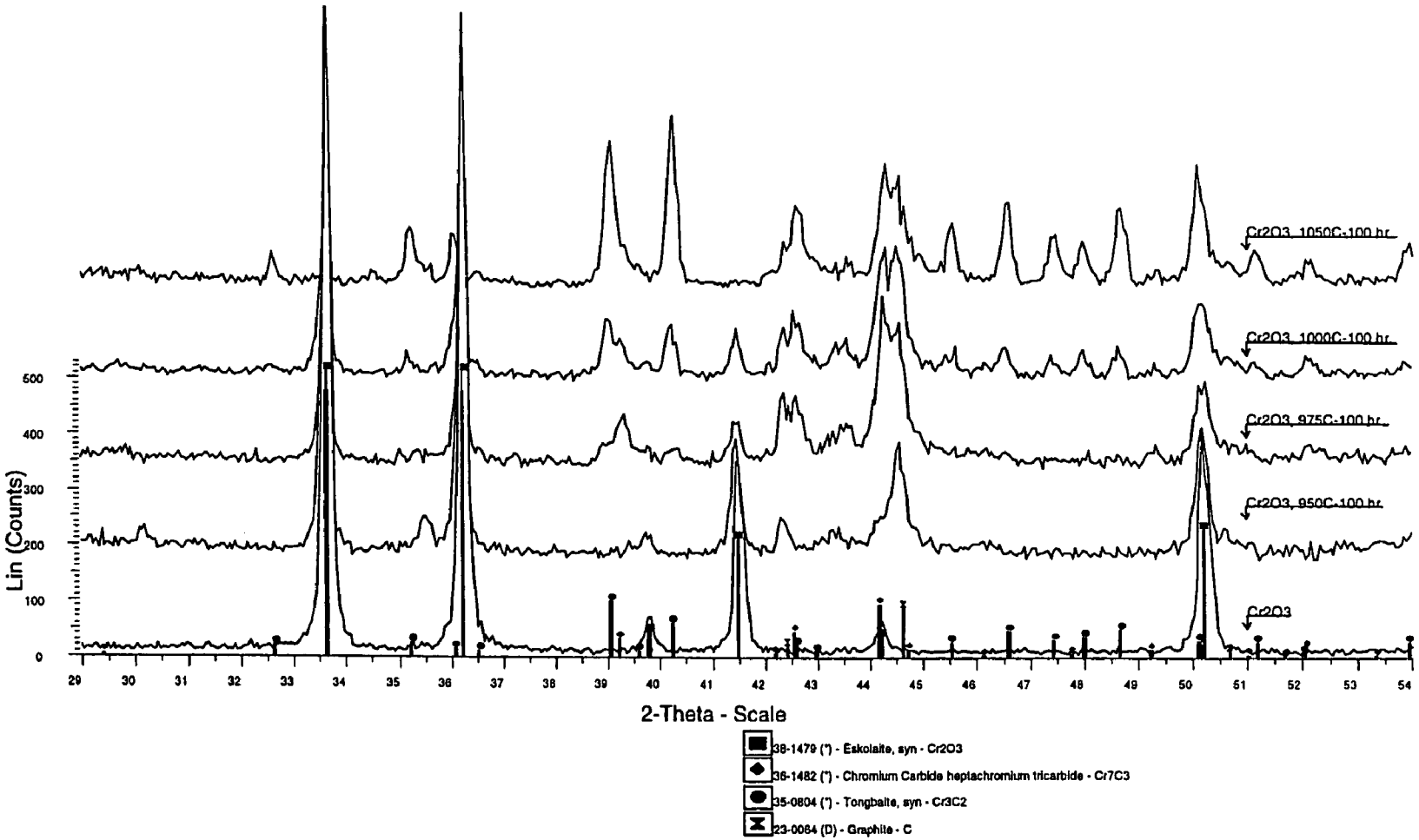
FIG. 5 are X-ray diffraction spectra demonstrating the thermal stability of pure chromia powder ($Cr_2O_3$, bottom spectrum with no graphite) in the temperature range of 950-1050° C. under a carbon activity of essentially one ($a_c \cong 1$).

Chromia ($Cr_2O_3$) powder (≧98% purity) was obtained from SIGMA-ALDRICH. The spinel $MnCr_2O_4$ powder was manufactured in-house to a purity of ≧98% and its structure confirmed by x-ray diffraction. X-ray Diffraction analysis was carried out using a Siemens D5000 unit with a Cu x-ray source using a 40 KV accelerating voltage and a current of 30 ma (shown as FIG. 5 for chromia). Crystal structure analysis and assignment was carried out using a Bruker DiffracPlus software package and a PDF-1 database.

Thermal stability analysis was carried out in a controlled atmosphere furnace in the temperature range of 950 to 1150° C. with temperature calibrated to ±2° C. and controlled to ±0.1° C. The atmosphere investigated was selected from conditions of vacuum (~$10^{-3}$ torr), or an argon (>99.999% purity) atmosphere, or an argon-5% hydrogen atmosphere, and maintaining a dynamic pressure of 200 mtorr, 1-2 torr or 800 torr. Run times for the study ranged from 4 hours to 300 hours. The conditions selected for the majority of the work at longer run-times were 1-2 torr argon and time steps of 100 hours. The pure powder reference samples were mechanically blended with high purity graphite and placed in a ceramic crucible with a graphite overlayer to approximate an effective carbon activity of approximately one ($a_c \cong 1$). The stainless steel samples with the current invention of a spinel overcoating were painted with a graphite paste and then placed in a ceramic crucible and covered with graphite to approximate unit carbon activity.

The results for chromia show that the carbide $Cr_7C_3$ was first detected under 100 hours at 950° C., and formation of the carbide $Cr_3C_2$ was first observed after 100 hours of 975° C.

In similar experiments with the spinel powder and the spinel overcoating of the present invention, carbide formation was not detected for temperatures of at least 25° C. higher.

Example 4

During the cracking of ethane, coke is formed or laid down, in both the coils and the transfer line exchangers (TLEs) commonly referred to as quench exchangers. As the thickness of the coke builds up, there is an increase in the pressure drop through both the furnace coils and the quench exchangers. Eventually the rise in pressure drop, either in the coils or in the quench exchangers, requires the feed to the furnace to be removed and the furnace decoked. The criteria for decoking the commercial furnaces in this example is either a coil pressure drop of 200 kPa or a TLE pressure drop of 175 kPa, which ever occurs first. The commercial furnace performance is illustrated in the following two figures.

Figure 6:
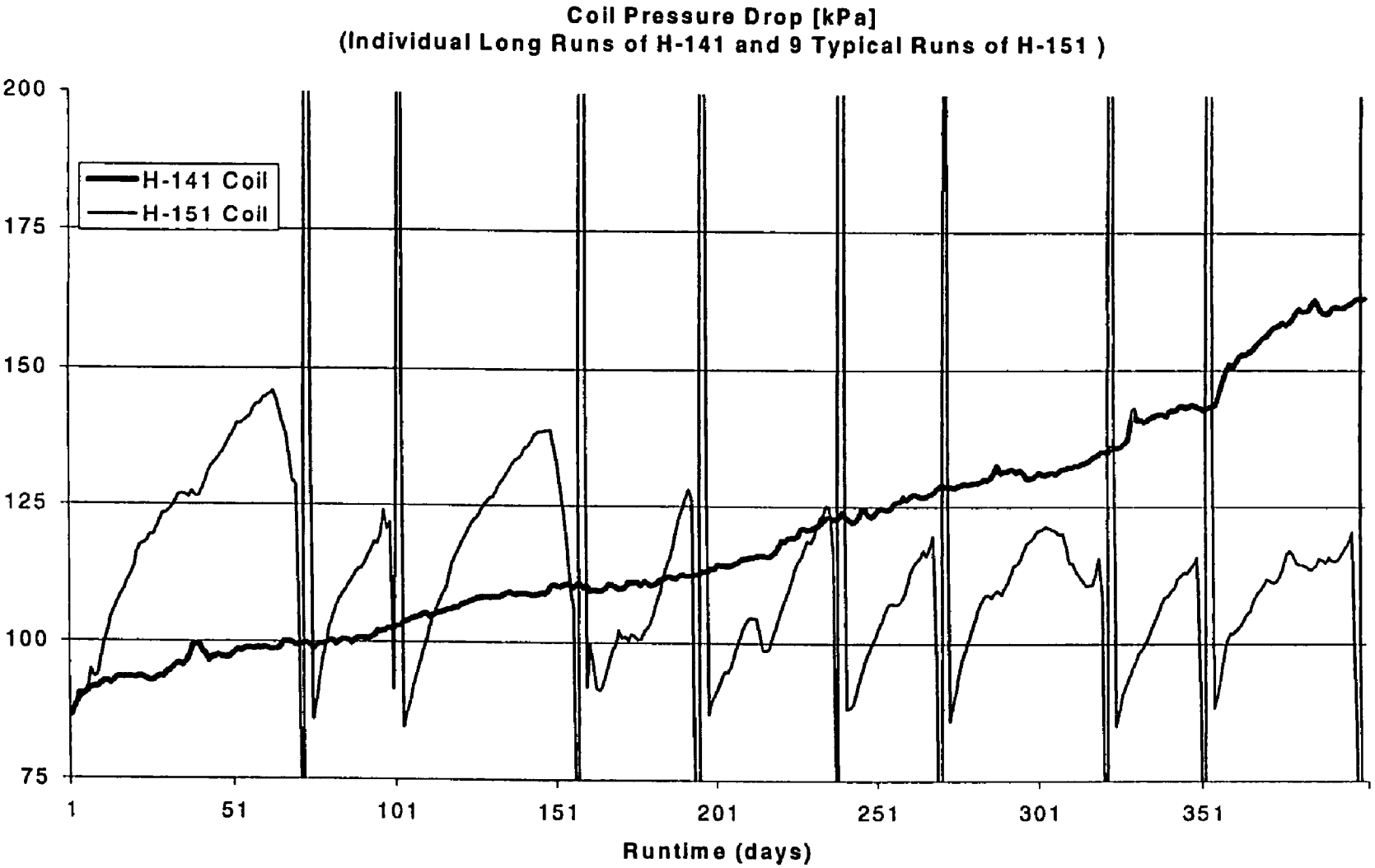
FIG. 6 is a coil pressure drop (kPa) of individual long runs of H-141 and 9 typical runs of H-151.

FIG. 6 provides the pressure drop through the coils of a typical furnace (H-151) for nine cycles or run times. The typical furnace (H-151) shows that at start of run, the coil pressure drop is about 85 kPa. The coil pressure drop increases to between 120 kPa and 140 kPa prior to being decoked which indicates that furnace H-151 was not decoked due to a rise in coil pressure drop. When the furnace feed is removed and the furnace effluent switched to the decoke system, there is a rise in the coil pressure drop to over 200 kPa. Also shown is the coil pressure drop for a furnace (H-141) in which new coils, with the surface claimed in this patent, have been installed. The graph illustrates that the rate of increase in coil pressure drop was significantly lower then a typical furnace. The graph also shows that the furnace was not decoked during the four hundred days (it was decoked after a run time of 413 days). The small variation in pressure drops are due to the fact that in a commercial furnace and plant, there are changes to system pressures caused by changing ambient temperatures and plant feed rates.

Figure 7:
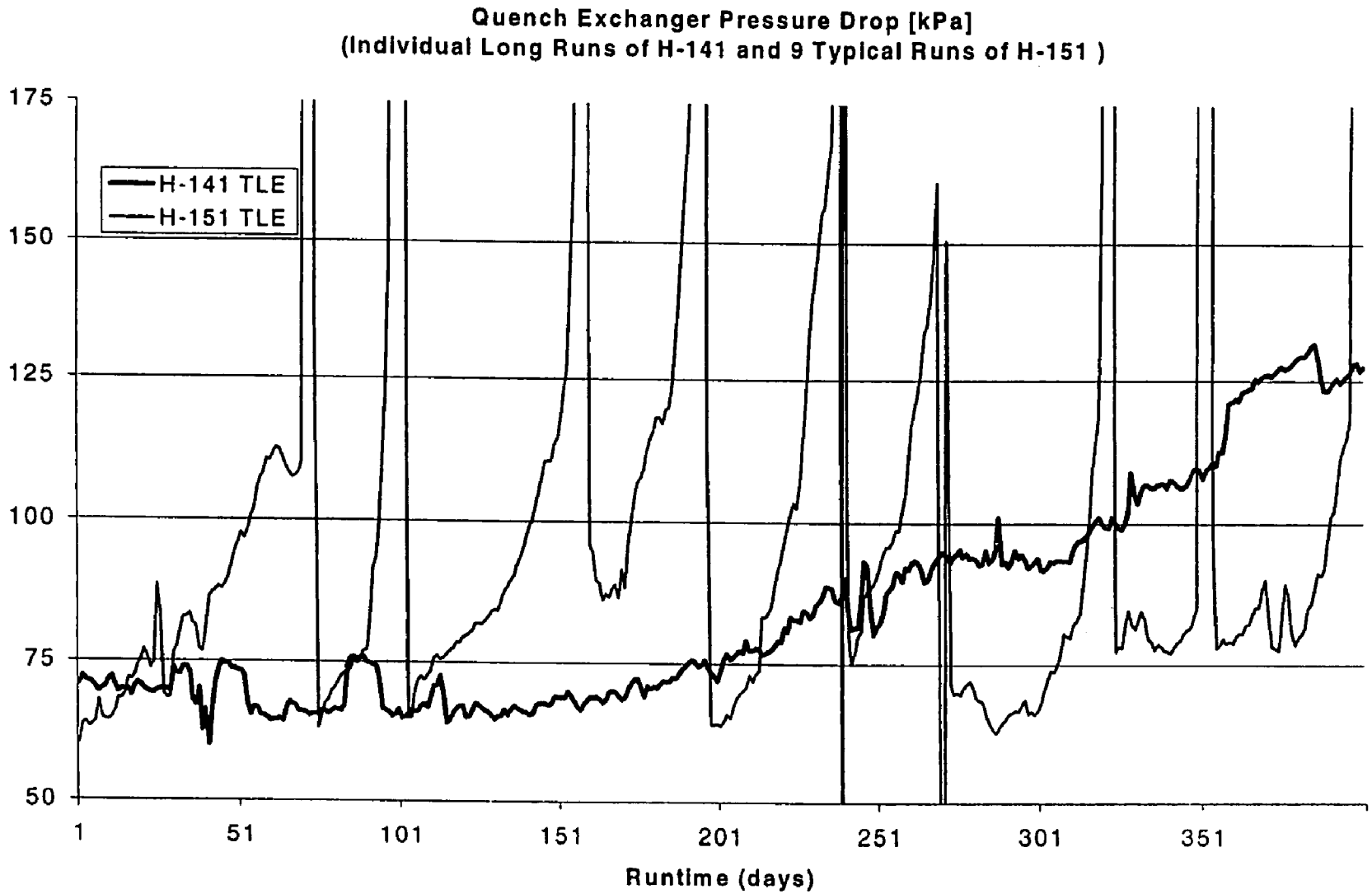
FIG. 7 is a quench exchanger pressure drop (kPa) of individual long runs of H-141 and 9 typical runs of H-151.

FIG. 7 provides the pressure drop through the quench exchangers (TLEs) for the same two furnaces. The typical furnace (H-151) shows that the typical start of run is about 65 kPa and that the pressure drop increase fairly quickly to over 100 kPa, then the rate of increase is much faster as tubes in the quench exchanger become blocked with coke. The graph clearly illustrates that the ability to fully decoke or remove all the coke from the quench exchanger by decoking the furnace is limited and that eventually a typical furnace needs to be shut down and the quench exchangers mechanically cleaned. Furnace H-141 graph illustrates very little coke build up in the quench exchanger for the first 200 days and then a gradual increase to over 125 kPa. The reason that the rate of pressure drop increase was much more gradual is that the nature of the fouling was different. Typically the coke build up is at the inlet to the quench exchangers and results in fully blocked quench exchanger tubes. With the significant reduction in the amount of coke made in the coils and the quench exchanger, H-141 TLEs slowly fouled by small pieces of coke being deposited through out the length of the tubes of the quench exchangers and not at the inlet.

INDUSTRIAL APPLICABILITY

The present invention provides a process for preparing a surface on stainless steel which is resistant to coking.

The invention claimed is:

1. A process for treating a stainless steel surface comprising from 20 to 50 weight % of chromium, 25 to 50 weight % of Ni, from 1.0 to 2.5 weight % of Mn less than 1.0 weight % of niobium, less than 1.5 weight % of silicon, less than 3 weight % of titanium and all other trace metals and carbon in an amount less than 0.75 weight % to produce an outer surface at least 80% of which is spinel of the formula $Mn_xCr_{3-x}O_4$ wherein x is from 0.5 to 2, having a surface area at least 50% greater than the surface area of underlying chromia on the surface of said stainless steel which process comprises:

(i) heating the stainless steel in a reducing atmosphere comprising from 50 to 100 weight % of hydrogen and from 0 to 50 weight % of one or more inert gases at rate of 100° C. to 150° C. per hour to a temperature from 800° C. to 1100° C.;

(ii) then subjecting the stainless steel to an oxidizing environment having an oxidizing potential equivalent to a mixture of from 30 to 50 weight % of air and from 70 to 50 weight % of one or more inert gases at a temperature from 800° C. to 1100° C. for a period of time from 5 to 40 hours; and (iii) cooling the resulting stainless steel to room temperature at a rate of less than 200° C. per hour.

2. The process according to claim 1, wherein in step (i) the reducing atmosphere comprises 60 to 100 weight % of hydrogen and 0 to 40 weight % of one or more inert gases.

3. The process according to claim 2, wherein in step (ii) the oxidizing environment comprises 40 to 50 weight % of air and the balance one or more inert gases selected from the group consisting of nitrogen and argon.

4. The process according to claim 3, wherein in step (i) the rate of temperature increase is from 120° C. to 150° C. per hour.

5. The process according to claim 4, wherein in step (ii) the time is from 10 to 25 hours.

* * * * *